US010786053B2

(12) United States Patent
Siahaan et al.

(10) Patent No.: US 10,786,053 B2
(45) Date of Patent: Sep. 29, 2020

(54) WOVEN MATERIAL INCLUDING DOUBLE LAYER CONSTRUCTION

(71) Applicant: Apple Inc., Cupertino, CA (US)

(72) Inventors: Edward Siahaan, Cupertino, CA (US); Whitney D. Mattson, Cupertino, CA (US); Yoji Hamada, Tokyo-to (JP)

(73) Assignee: Apple Inc., Cupertino, CA (US)

( * ) Notice: Subject to any disclaimer, the term of this patent is extended or adjusted under 35 U.S.C. 154(b) by 433 days.

(21) Appl. No.: 14/930,558

(22) Filed: Nov. 2, 2015

(65) Prior Publication Data

US 2016/0309857 A1 Oct. 27, 2016

Related U.S. Application Data

(63) Continuation of application No. 14/306,908, filed on Jun. 17, 2014, now abandoned.

(51) Int. Cl.

| | |
|---|---|
| ***A44C 5/00*** | (2006.01) |
| ***D03D 11/00*** | (2006.01) |
| ***D03D 17/00*** | (2006.01) |
| ***D03D 41/00*** | (2006.01) |
| ***D03D 3/02*** | (2006.01) |
| ***D03D 15/00*** | (2006.01) |
| ***D03D 3/00*** | (2006.01) |

(52) U.S. Cl.

CPC ..... *A44C 5/0053* (2013.01); *D03D 3/005* (2013.01); *D03D 3/02* (2013.01); *D03D 11/00* (2013.01); *D03D 15/0033* (2013.01); *D03D 17/00* (2013.01); *D03D 41/00* (2013.01)

(58) Field of Classification Search

CPC ..... D03D 3/02; D03D 11/00; D03D 11/02; D03D 3/005; D03D 15/0033; D03D 17/00; D03D 41/00; Y10T 442/3195; Y10T 442/3203; Y10T 442/3211; Y10T 442/3472–3699; Y10T 428/1362; Y10T 428/1369; Y10T 428/139; Y10T 428/1393; Y10T 428/1397; A44C 5/0053

USPC ..... 139/387 R, 388, 408–415; 428/36.1, 428/36.3, 36.9, 36.91, 36.92; 442/205–207, 224, 226, 227, 239–267, 442/203

See application file for complete search history.

(56) References Cited

U.S. PATENT DOCUMENTS

| | | | |
|---|---|---|---|
| 870,697 | A * | 11/1907 | Stevenson |
| 2,696,839 | A | 12/1954 | Schuerhoff |

(Continued)

FOREIGN PATENT DOCUMENTS

| | | |
|---|---|---|
| BE | 555150 | 2/1957 |
| CH | 335252 | 2/1959 |

(Continued)

*Primary Examiner* — Vincent Tatesure

(74) *Attorney, Agent, or Firm* — Morgan, Lewis & Bockius LLP

(57) ABSTRACT

A woven material including a four layer construction formed by distinct groups of warp threads, and a method of forming the woven material. The woven material may include a first group of warp threads, and an interior weft thread portion coupled to the first group of warp threads. The woven material may also include a second group of warp threads substantially surrounding the first group of warp threads and the interior weft thread portion, and an exterior weft thread portion coupled to the second group of warp threads.

19 Claims, 11 Drawing Sheets

(56) References Cited

U.S. PATENT DOCUMENTS

| | | | | |
|---|---|---|---|---|
| 3,362,595 | A | 1/1968 | Herzog | |
| 3,885,383 | A | 5/1975 | Tanaka | |
| 4,585,037 | A | 4/1986 | Kimbara | |
| 4,662,407 | A | 5/1987 | Duncan | |
| 4,748,078 | A | 5/1988 | Doi et al. | |
| 4,846,230 | A | 7/1989 | Mock et al. | |
| 4,856,837 | A * | 8/1989 | Hammersla, Jr. | B66C 1/18 139/411 |
| 5,089,669 | A | 2/1992 | Piper et al. | |
| 5,219,636 | A | 6/1993 | Golz | |
| 5,437,314 | A | 8/1995 | Sainen | |
| 5,438,851 | A | 8/1995 | Geissbuhler | |
| 5,465,762 | A | 11/1995 | Farley | |
| 5,529,826 | A | 6/1996 | Tailor et al. | |
| 6,336,475 | B2 | 1/2002 | Dewispelaere et al. | |
| 6,376,047 | B1 | 4/2002 | Hasegawa | |
| 7,143,437 | B2 | 11/2006 | Royer et al. | |
| 7,275,667 | B2 | 10/2007 | Bertucci | |
| 7,836,917 | B1 | 11/2010 | Osborne | |
| 7,909,066 | B2 | 3/2011 | Wada | |
| 8,039,083 | B2 | 10/2011 | Higashinaka et al. | |
| 8,603,374 | B2 | 12/2013 | Domagalski et al. | |
| 8,651,150 | B2 | 2/2014 | Siebert | |
| 2006/0166577 | A1 | 7/2006 | Rashed | |
| 2010/0203268 | A1* | 8/2010 | Russell | B29C 70/222 428/34.1 |
| 2011/0059325 | A1* | 3/2011 | Juan | B32B 5/26 428/458 |
| 2013/0008554 | A1 | 1/2013 | Fisher et al. | |
| 2014/0135906 | A1 | 5/2014 | Winner et al. | |
| 2016/0037866 | A1 | 2/2016 | Rohrbach et al. | |
| 2016/0255921 | A1* | 9/2016 | Hamada | D03D 47/347 |
| 2016/0258084 | A1* | 9/2016 | Hatanaka | D03D 13/004 |

FOREIGN PATENT DOCUMENTS

| | | |
|---|---|---|
| CN | 201546014 | 8/2010 |
| CN | 203382963 | 1/2014 |
| CN | 203513965 | 4/2014 |
| EP | 0036527 | 3/1981 |
| FR | 1217530 | 5/1960 |
| JP | 2006130167 | 5/2006 |
| JP | 2012172281 | 9/2012 |
| WO | WO2009059209 | 5/2009 |

* cited by examiner

WOVEN MATERIAL INCLUDING DOUBLE LAYER CONSTRUCTION

CROSS-REFERENCE TO RELATED APPLICATION

This application is a continuation patent application of U.S. patent application Ser. No. 14/306,908, filed Jun. 17, 2014 and titled "Woven Material Including Double Layer Construction," the disclosure of which is hereby incorporated herein by reference in its entirety.

FIELD

The disclosure relates generally to a woven material, and more particularly, to a woven material including a double layer construction formed by four distinct groups of warp threads, and a method of forming the woven material.

BACKGROUND

Conventional woven material or fabric is used in a plurality of applications or industries. For example, woven material is used in clothing/apparel (e.g., shirts, pants, skirts, etc.), in fashion accessories (e.g., bracelets, watch bands, necklaces, etc.), in electronics (e.g., woven conductive layers, protective outer sheath for optical fiber cables), and other various industrial applications (e.g., rope, tape, protective gear, household/kitchenware, etc.). Due to the many uses and applications, conventional woven material is manufactured using specific material and/or manufactured to include specific physical properties. For example, where the woven material is used to form a bracelet or necklace, it may be desired that the woven material be flexible to contour around the surface in which the woven material is worn (e.g., wrist, neck). Additionally, it may be desired that the woven material forming the bracelet or necklace be durable, flexible and/or capable of withstanding typical wear/treatment of a bracelet or necklace. Furthermore, it may be desired that the woven material forming the bracelet or necklace be capable of forming unique designs or cosmetic embellishments including unique color patterns or portions having varied dimensions (e.g., tapered portions).

Conventional woven material or fabrics are made by continuously weaving a weft thread around a plurality of warp threads. The woven or interlaced weft thread and warp threads form the exterior surface (e.g., top portion, bottom portion) of the woven material. Additionally, because weft thread and warp threads only form the exterior surface of the woven material, a filler material is included within an internal cavity of the woven material to provide thickness and/or structure to the woven material.

However, conventional woven material, as discussed above, typically include structural and cosmetic issues. For example, conventional woven material may include inconsistent thicknesses, especially where the woven material includes a tapered portion and width of the woven material increases. The increase in the width of the woven material may decrease the fiber density of the woven material, which may result in structural issues (e.g., weakening of the woven material) and cosmetic issues (e.g., distortion of the woven material/pattern). In another example, the inclusion of filler material in conventional woven material may cause inconsistencies in the thickness of the woven material, as a result of the filler materials ability to move or become displaced within the woven material. Additionally, the inclusion of filler material within the conventional woven material may require additional warp threads to fill internal cavity of the woven material, which may result in a stiffer and/or harder (e.g., rough, coarse) woven material. Finally, as a result of the warp threads only forming the exterior surfaces of the conventional woven material, the woven material is cosmetically or aesthetically limited to a patterned formed from the exposed warp threads and/or weft thread.

SUMMARY

Generally, embodiments discussed herein are related to a woven material including a double layer construction, a wearable band formed from the double layer woven material and a method of forming the woven material including the double layer construction. The double layer construction may include four distinct groups or layers of warp threads; two outer groups (e.g., top portion/surface, bottom portion/surface) and two internal groups (e.g., inner portions), and a weft thread(s) coupled to each of the four distinct layers/groups of warp threads. As a result of forming the woven material from four distinct layers/groups of warp threads, the need for filler material within the woven material may be eliminated. As a result of eliminating the filler material, the woven material including the four layer construction may be substantially soft and/or less coarse when compared to a conventional woven material. Additionally, by eliminating the filler material, and forming the woven material using the four layer construction, the woven material may include more consistent and/or uniform thickness. For example, where the woven material includes a tapered portion, the thickness of the woven material may remain substantially uniform as a result of the four layer construction. More specifically, as the width of the woven material gets larger in the tapered portion, the length of the weft thread in the four layer construction may also increase for each of the four distinct groups of warp threads, which may result in consistent weft thread density even when the width of the woven material increases. Finally, as a result of forming the woven material from the four distinct groups of warp threads, the woven material may include more intricate patterns (e.g., more colors) without the need to add additional warp thread to the woven material.

One embodiment may include a woven material. The woven material may include a first group of warp threads, and an interior weft thread portion coupled to the first group of warp threads. The woven material may also include a second group of warp threads substantially surrounding the first group of warp threads and the interior weft thread portion, and an exterior weft thread portion coupled to the second group of warp threads.

Another embodiment may include a wearable band. The wearable band may include a woven material. The woven material may include a plurality of warp threads extending along a length of the woven material. The plurality of warp threads may include a first warp thread positioned within an inner portion of the woven material in a first section of the length of the woven material, and a second warp thread positioned on a top surface and a bottom surface of the woven material in the first section of the length of the woven material. The woven material may also include a weft thread coupled to the plurality of warp threads.

A further embodiment may include a method of forming the woven material. The method may include providing a plurality of warp threads. The plurality of warp threads may include a first layer of warp threads forming a top surface of the woven material, a second layer of warp threads positioned adjacent the first layer of warp threads. The second layer of warp threads may be positioned in an inner portion of the woven material. The plurality of warp threads may also include a third layer of warp threads positioned adjacent the second layer of warp threads. The third layer of warp threads may be positioned in the inner portion of the woven material. Finally, the plurality of warp threads may include a fourth layer of warp threads positioned adjacent the third layer of warp threads, where the fourth layer of warp threads forming a bottom surface of the woven material. The method may also include continuously weaving at least one weft thread through the plurality of warp threads over a length of the plurality of warp threads, and in a first section of the length of the plurality of warp threads, switching at least one warp thread of the first layer of warp threads with at least one corresponding warp thread of the second layer of the warp threads.

BRIEF DESCRIPTION OF THE DRAWINGS

The disclosure will be readily understood by the following detailed description in conjunction with the accompanying drawings, wherein like reference numerals designate like structural elements, and in which.

Figure 1:
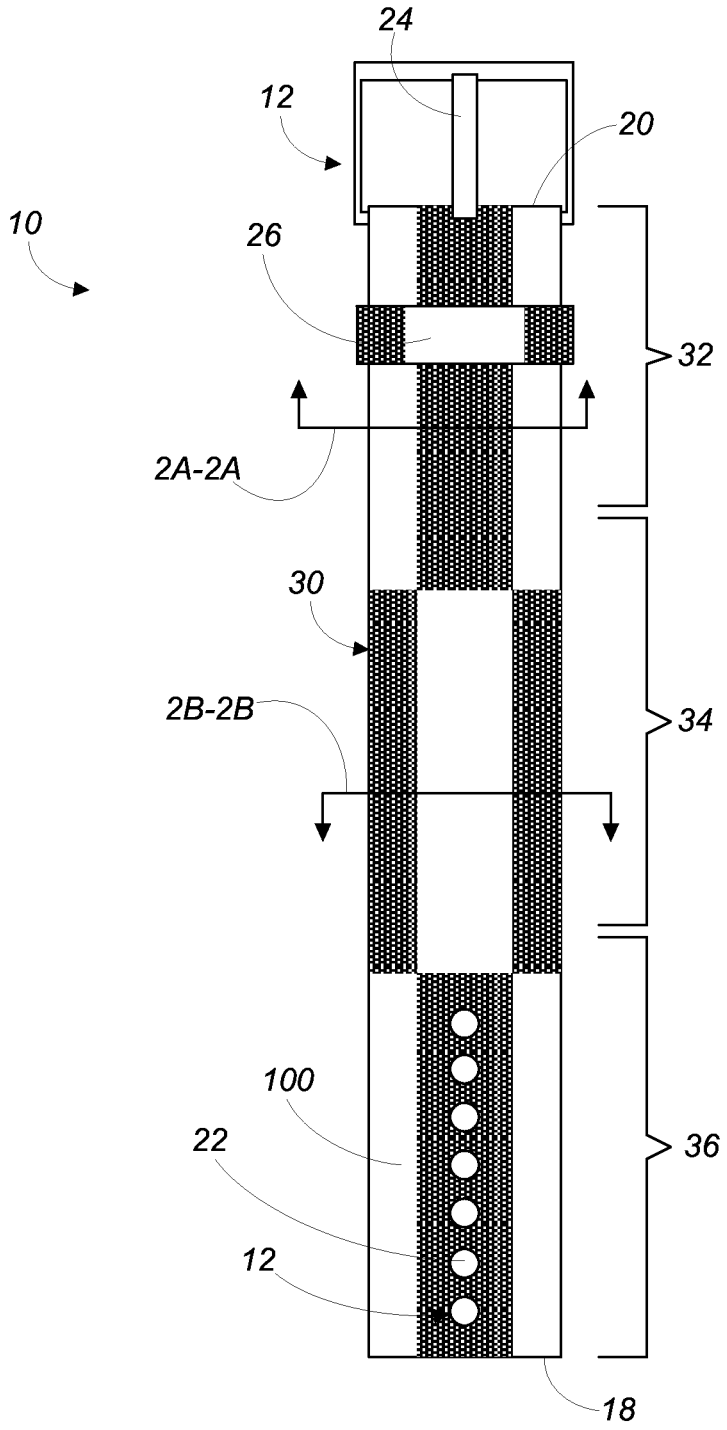
FIG. 1 shows an illustrative front view of a wearable band formed from a woven material, according to embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates generally to a woven material, and more particularly, to a woven material including a double layer construction formed by four distinct groups of warp threads, and a method of forming the woven material.

The double layer construction may include four distinct groups or layers of warp threads; two outer groups (e.g., top portion/surface, bottom portion/surface) and two internal groups (e.g., inner portions), and a weft thread(s) coupled to each of the four distinct layers/groups of warp threads. As a result of forming the woven material from four distinct layers/groups of warp threads, the need for filler material within the woven material may be eliminated. As a result of eliminating the filler material, the woven material including the four layer construction may be substantially soft and/or less coarse when compared to a conventional woven material. Additionally, by eliminating the filler material, and forming the woven material using the four layer construction, the woven material may include more consistent and/or uniform thickness. For example, where the woven material includes a tapered portion, the thickness of the woven material may remain substantially uniform as a result of the four layer construction. More specifically, as the width of the woven material gets larger in the tapered portion, the length of the weft thread in the four layer construction may also increase for each of the four distinct groups of warp threads, which may result in consistent weft thread density even when the width of the woven material increases. Finally, as a result of forming the woven material from the four distinct groups of warp threads, the woven material may include more intricate patterns (e.g., more colors) without the need to add additional warp thread to the woven material.

These and other embodiments are discussed below with reference to FIGS. 1-9. However, those skilled in the art will readily appreciate that the detailed description given herein with respect to these Figures is for explanatory purposes only and should not be construed as limiting.

FIG. 1 shows an illustrative front view of a wearable band 10 including woven material 100, according to embodiments. In non-limiting examples, wearable band 10 may include a decorative band (e.g., wristband, armband, headband, necklace, etc.), a watch band, and a wearable band for holding an electronic device including, but not limited to: a smartphone, a gaming device, a display, a digital music player, a wearable computing device or display, and a health monitoring device. As shown in FIG. 1, wearable band 10 may form a watch band.

Wearable band 10 may include coupling component 12 positioned at distinct ends 18, 20 of wearable band 10. Coupling component 12 may be formed within wearable band 10 to coupled ends 18, 20 and/or secure wearable band 10 to a user. Coupling component 12 may be any suitable coupling mechanism or embodiment capable of releasably coupling ends 18, 20 of wearable band 10. In a non-limiting example, as shown in FIG. 1, coupling component 12 includes a plurality of holes 22 formed through wearable band 10 adjacent end 18, and a buckle clasp 24 positioned at end 20. When wearable band 10 is worn by a user, end 18 is positioned through engagement buckle clasp 24, such that a portion of buckle clasp 24 may be positioned within one of the plurality of holes 22 formed through wearable band 10 to secure wearable band 10. End 18 may be further secured to wearable band 10 using reed loop 26 positioned substantially around wearable band 10. Reed loop 26 may form an opening (not shown) located between wearable band 10 and reed loop 26, configured to receive end 18 and/or positioned end 18 against a portion of wearable band 10. As discussed herein, reed loop 26 may also be made from woven material 100. By making both wearable band 10 and reed loop 26 from woven material 100, the cost and/or time of manufacturing wearable band 10 including reed loop 26 may be substantially reduced.

As shown in FIG. 1, woven material 100 forming wearable band 10 may include a plurality of colors and/or distinct patterns. That is, wearable band 10, formed from woven material 100, may include a decorative pattern 30. In a non-limiting example, as shown in FIG. 1, decorative pattern 30 of woven material 100 may divide wearable band 10 into distinct lengths. More specifically, wearable band 10 may have a first length 32, a second length 34 and a third length 36, where each length of wearable band 10 may be defined by a portion of decorative pattern 30 of woven material 100. As shown in FIG. 1, first length 32 and third length 36 may include substantially similar decorative patterns. However, it is understood that decorative pattern 30 of woven material 100 forming wearable band 10 may not be symmetrical and/or repetitive, and no length of wearable band 10 may be substantially similar to a distinct length of wearable band 10. As discussed herein, decorative pattern 30 may be formed based on the colors and/or positioning of the threads (e.g., weft, warp) used to form woven material 100.

Figure 2A:
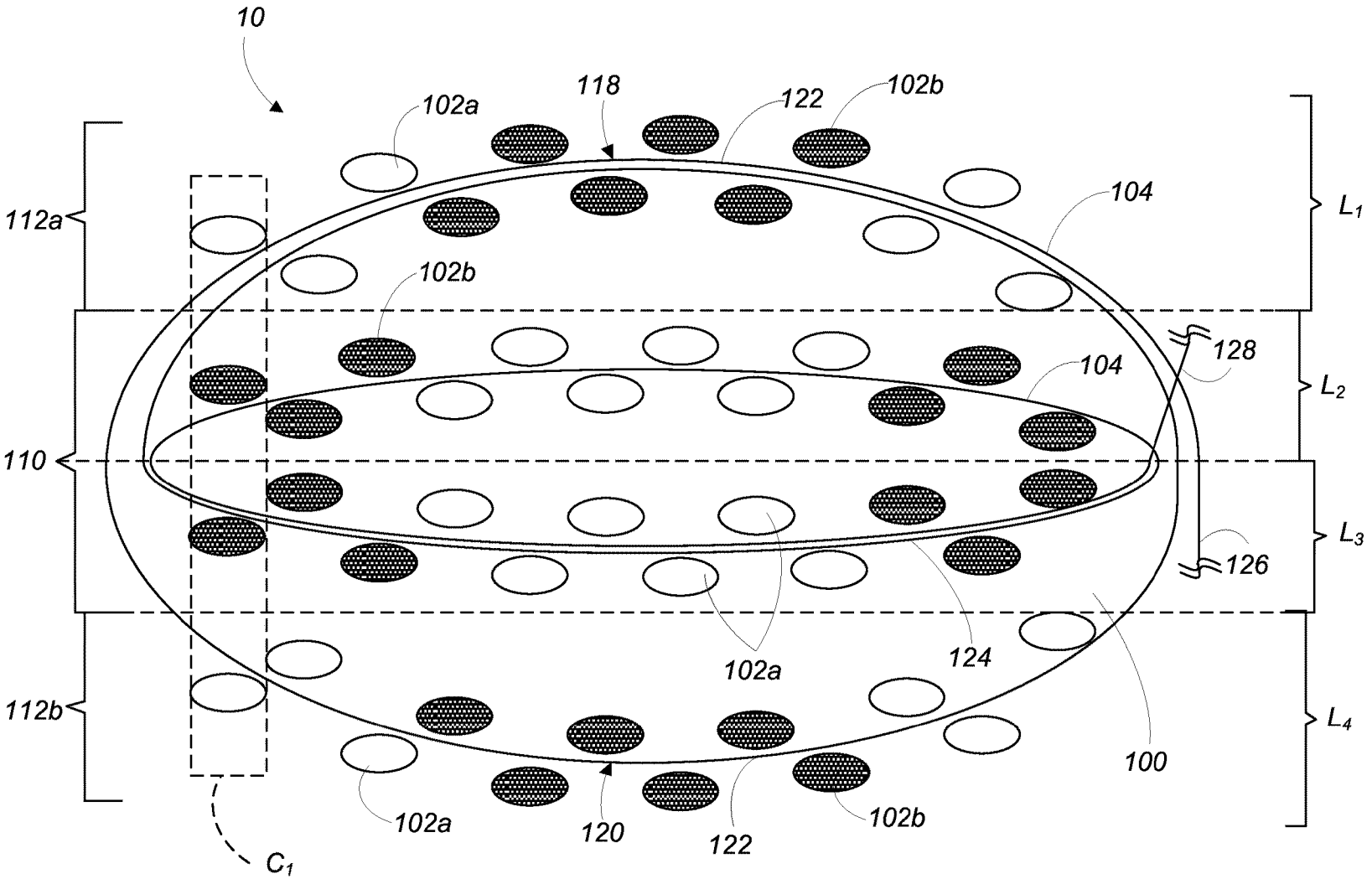
FIG. 2A shows a cross-section view of a first section of the wearable band of FIG. 1A taken along line 2A-2A, according to embodiments.

FIG. 2A shows a cross-section view of first length 32 of the wearable band 10 of FIG. 1 taken along line 2A-2A. The cross-section view of FIG. 2A may be taken at a crossing of woven material 100 prior to the transition or position change of the warp threads within the woven material 100. That is, and as discussed herein, the plurality of warp threads may be coupled to, or continuously woven with (e.g., above, below) at least one weft thread to form woven material 100. As such, in the cross-section of woven material 100 in FIG. 2A, the warp threads are depicted as being in an instantaneous position about the weft thread, prior to and/or subsequent to the warp threads being woven through the weft thread. It is understood that the position of the warp threads in FIG. 2A is not permanent, and/or the warp threads are not fixed in the depicted position.

It is also understood that the number of threads shown in FIG. 2A to form woven material 100 may be merely exemplary, and may not represent the actual number of warp threads and/or weft threads used to form woven material 100. In a non-limiting example, woven material 100 may be formed from more than 200 warp threads and a single weft thread coupled to, woven or interlaced between the plurality of warp threads. In conjunction, the spacing between the warp threads and/or weft threads as shown in FIG. 2A may also be merely exemplary for the purpose of clearly and completely describing woven material 100. It is understood that the space between the threads of woven material 100 may only be large enough to couple and/or weave at least one weft thread through the plurality of warp threads (e.g., 200 warp threads) to form woven material 100. Additionally, the spacing between the threads of woven material 100 may be substantially minimal such that a user may not be able to see through woven material 100.

As discussed herein, wearable band 10 may be formed from woven material 100 including a plurality of warp threads 102*a*, 102*b* and at least one weft thread 104 coupled to the warp threads 102*a*, 102*b*. More specifically, woven material 100 may include warp threads 102*a*, 102*b* positioned along the length of wearable band 10, and at least one weft thread 104 positioned perpendicular to, and coupled to, woven or interlaced between the plurality of warp threads 102*a*, 102*b*. It is understood that the plurality of warp threads 102*a*, 102*b* may run the entire length of woven material 100 forming wearable band 10. Additionally, it is understood that the at least one weft thread 104 may be formed from a single thread that may be continuously woven between warp threads 102*a*, 102*b*, or may be formed from a plurality of threads that may be woven between warp threads 102*a*, 102*b* (see, FIG. 6A). Woven material 100, as discussed herein, may be formed using an suitable weaving technique and/or weaving machinery. In a non-limiting example, woven material 100 may be formed using a dobby loom.

Warp threads 102*a*, 102*b* and the weft thread 104 may be formed from any suitable material capable of being coupled, woven or interlaced with each other to form woven material 100. In a non-limiting example, warp threads 102*a*, 102*b* and weft thread 104 of woven material 100 may be formed from or include a polyamide (e.g., nylon) material, a polyester material, thermoplastic polyethylene (e.g., Dyneema) or a polypropylene material. Warp threads 102*a*, 102*b* and weft thread 104 of woven material 100 may also be formed from any other suitable polymer material that may include similar physical characteristics as polyester and/or polypropylene. Warp threads 102*a*, 102*b* and weft thread 104 may be formed from the same material or may be formed from distinct materials when forming woven material 100.

Although discussed herein as being formed from plastic-based materials (e.g., polyamide, polyester, and so on), it is understood that warp threads 102*a*, 102*b* and/or weft threads 104 of woven material 100 may be formed from other materials. These materials may be used in place of, or in combination with other materials for forming warp threads 102*a*, 102*b* and/or weft threads 104, as discussed herein. In non-limiting examples, warp threads 102*a*, 102*b* and/or weft threads 104 may be formed from natural materials including cotton, silk and wool. In other non-limiting examples, warp threads 102*a*, 102*b* and/or weft threads 104 may be formed from treated (e.g., sealant spray) or coated (e.g., resin coating) flexible materials that may be capable of being coupled, woven or interlaced with each other to form woven material 100. The treated or coated flexible material may prevent and/or minimize stains, wear and/or fading of warp threads 102*a*, 102*b* and/or weft threads 104, and/or the distinct colors of the threads in woven material 100 over time and/or use. In additional non-limiting examples, warp threads 102*a*, 102*b* and/or weft threads 104 may be formed from materials having specific optical or illuminative properties. More specifically, warp threads 102*a*, 102*b* and/or weft threads 104 forming woven material 100 may be formed from materials that include reflective properties, and/or glow-in-the-dark properties, so woven material 100 may be seen in dimly lit, or dark areas.

As shown in FIG. 2A, and discussed in detail herein, warp threads 102*a*, 102*b* may include distinctly colored threads, where warp threads 102*a* is a first color and warp threads 102*b* is a second color, distinct from the first color of warp threads 102*a*. That is, and as discussed herein, warp threads 102*a*, 102*b* may be formed from distinctly colored threads that may form the pattern or color scheme of woven material 100.

Woven material 100 may include a first group 110 of warp threads 102*a*, 102*b*, and a second group 112*a*, 112*b* of warp threads 102*a*, 102*b* substantially surrounding first group 110 of warp threads 102*a*, 102*b*. That is, first group 110 of warp threads 102*a*, 102*b* may form an inner portion of woven material 100, and second group 112*a*, 112*b* of warp threads 102*a*, 102*b*, collectively, may form an outer portion or a top surface 118 and a bottom surface 120 of woven material 100. The first group 110 of warp threads 102*a*, 102*b* may not be seen by a user of wearable band 10, and the second group 112*a*, 112*b* of warp threads 102*a*, 102*b* forming top surface 118 and bottom surface 120 of woven material 100 may be seen by the user of wearable band 10. As shown in FIG. 2A, both first group 110 and second group 112*a*, 112*b* of warp threads 102*a*, 102*b* may include warp threads 102*a* having a first color, and warp threads 102*b* having a second color. That is, first group 110 may include warp threads 102*a* having a first color and warp threads 102*b* having a second color. Additionally, second group 112*a*, 112*b* may also include warp threads 102*a* having a first color and warp threads 102*b* having a second color.

Woven material 100 may include a single weft thread 104 coupled to, woven or interlaced between first group 110 and second group 112*a*, 112*b* of warp threads 102*a*, 102*b*. More specifically, the single weft thread 104 may include an exterior weft thread portion 122 coupled to the second group 112*a*, 112*b* of warp threads 102*a*, 102*b*, and an interior weft thread portion 124 coupled to the first group 110 of warp threads 102*a*, 102*b*. As shown in FIG. 2A, top surface 118 of woven material 100 may include a portion of exterior weft thread portion 122 coupled to a top portion of the second group 112*a* of warp threads 102*a*, 102*b*. Additionally, bottom surface 120 of woven material 100 may include a portion of exterior weft thread portion 122 coupled to a bottom portion of the second group 112*b* of warp threads 102*a*, 102*b*. The weft thread 104 woven between warp threads 102*a*, 102*b* may form consecutive-cross layers with respect to warp threads 102*a*, 102*b* in order to form woven material 100.

By including first group 110 and second group 112*a*, 112*b* of warp threads 102*a*, 102*b*, and exterior weft thread portion 122 and interior weft thread portion 124 of weft thread 104, woven material 100 may not need for filler material (not shown). That is, first group 110 and second group 112*a*, 112*b* of warp threads 102*a*, 102*b*, and exterior weft thread portion 122 and interior weft thread portion 124 of weft thread 104 may form a four layer ($L_{1-4}$) construction for woven material 100, which may provide a desired strength, structural support and/or stiffness to wearable band 10 formed from woven material 100, without the need for filler material.

As a result of weft thread 104 being a single thread, exterior weft thread portion 122 and interior weft thread portion 124 may form, in part, a double weave or thickness of weft thread 104 in woven material 100, as shown in FIG. 2A. Additionally, weft thread 104 may be continuously woven through and/or coupled to warp threads 102*a*, 102*b* to form the various layers or rows of woven material 100. That is, and as discussed herein, woven material 100 may be formed by coupling or continuously weaving weft thread 104 through the threads 102*a*, 102*b* to form four distinct layers ($L_{1-4}$) of woven material 100. As such, and as shown in FIG. 2A, weft thread 104 of woven material 100 may include a prior layer portion 126, which may form the beginning of weft thread 104 for the displayed or current layer, and a subsequent layer portion 128 positioned opposite prior layer portion 126. Prior layer portion 126 may be a portion of weft thread 104 that may be positioned in the prior layer of woven material 100, and previously woven through warp threads 102*a*, 102*b*. Conversely, subsequent layer portion 128 of weft thread 104 may be woven through the warp threads 102*a*, 102*b* of the displayed or current layer of woven material 100, and may be positioned to be subsequently woven through the subsequent layer of woven material 100.

As shown in FIG. 2A, and discussed herein, woven material 100 including first group 110 and second group 112*a*, 112*b* of warp threads 102*a*, 102*b*, and weft thread 104 may form four distinct layers ($L_{1-4}$) of warp threads 102*a*, 102*b* and weft thread 104 within woven material 100. A first layer ($L_1$) may include the top portion of the second group 112*a* of warp threads 102*a*, 102*b* and the portion of exterior weft thread portion 122 coupled to the second group 112*a* of warp threads 102*a*, 102*b*. As shown in FIG. 2A, first layer ($L_1$), and the various components included therein, may substantially form top surface 118 of woven material 100. A second layer ($L_2$) of woven material 100 may be positioned directly adjacent first layer ($L_1$). Second layer ($L_2$) may include a first portion of the first group 110 of warp threads 102*a*, 102*b* and a portion of interior weft thread portion 124. A third layer ($L_3$) may be positioned directly adjacent the second layer ($L_2$), and may include a second portion of the first group 110 of warp threads 102*a*, 102*b* and the remaining portion of interior weft thread portion 124. As shown in FIG. 2A, second layer ($L_2$) and third layer ($L_3$) may, collectively, form the inner portion of woven material 100, and may not be seen by a user of wearable band 10 formed from woven material 100, as discussed herein. Finally, woven material 100 may include a fourth layer ($L_4$) positioned directly adjacent third layer ($L_3$), and opposite first layer ($L_1$). Fourth layer ($L_4$) may substantially form bottom surface 120 of woven material 100, and may include the bottom portion of second group 112*b* of warp threads 102*a*, 102*b*, and the portion of exterior weft thread portion 122 coupled to second group 112*b* of warp threads 102*a*, 102*b*.

Each of the warp threads 102*a*, 102*b* in first layer ($L_1$) of woven material 100 may be substantially aligned with a corresponding warp thread 102*a*, 102*b* in the other layers (e.g., $L_{2-4}$) of woven material 100. That is, each of the warp threads 102*a*, 102*b* in first layer ($L_1$) may be in substantial alignment with a corresponding warp thread 102*a*, 102*b* in: the first group 110 of warp threads 102*a*, 102*b* included in the second layer ($L_2$); the first group 110 of warp threads 102*a*, 102*b* included in the third layer ($L_3$); and the second group 112*b* of warp threads 102*a*, 102*b* included in the fourth layer ($L_4$). Corresponding warp threads 102*a*, 102*b* of the four layers ($L_{1-4}$) of woven material 100 may be positioned and/or substantially aligned in the same columns (C) of warp threads 102*a*, 102*b* of woven material 100. In an non-limiting example as shown in FIG. 2A, woven material 100 may include a plurality of columns (C)(e.g., 12 columns), where each column (C) includes four (4) corresponding warp threads 102*a*, 102*b*; two warp threads 102*a*, 102*b* included in the first group 110, and two warp threads 102*a*, 102*b* included in the second group 112*a*, 112*b*. Specifically, as shown FIG. 2A, a first column ($C_1$) may include four (4) corresponding warp threads 102*a*, 102*b*, where the warp thread 102*a* included in first layer ($L_1$) may be in substantial alignment with: corresponding warp thread 102*b* of first group 110 in second layer ($L_2$); corresponding warp thread 102*b* of first group 110 in third layer ($L_3$); and corresponding warp thread 102*a* of second group 112*b* in fourth layer ($L_4$). As a result of the substantial alignment between warp threads 102*a*, 102*b* in woven material 100 and the four layer ($L_{1-4}$) construction of woven material 100, corresponding warp threads 102*a*, 102*b* may be positionally switchable within woven material 100 for forming variations in decorative pattern 30 of woven material 100, as discussed herein.

Figure 2B:
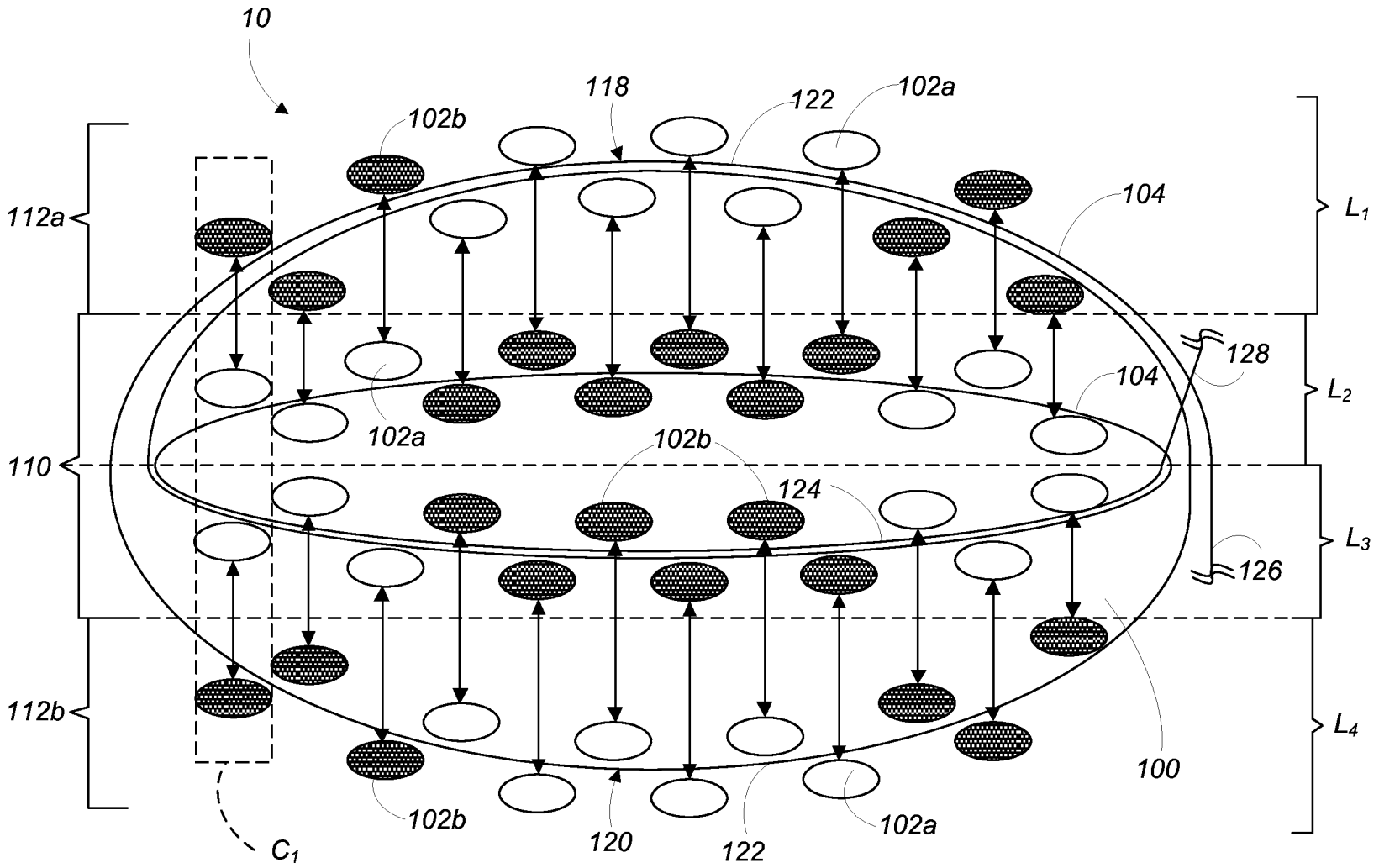
FIG. 2B shows a cross-section view of a second section of the wearable band of FIG. 1A taken along line 2B-2B, according to embodiments.

Turning to FIG. 2B, a cross-section view of second length 34 of the wearable band 10 of FIG. 1 taken along line 2B-2B is shown according to embodiments. With continued reference to FIGS. 1 and 2A, and as discussed herein, second length 34 of wearable band 10 may include a distinct decorative pattern 30 than the decorative pattern 30 in first length 32. In the non-limiting example as shown in FIGS. 1-2B, decorative pattern 30 of woven material 100 forming wearable band 10 at second length 34 may be substantially opposite to the decorative pattern 30 of woven material at first length 32.

The decorative pattern 30 of woven material 100 may be altered over the length of wearable band 10 by positionally switching warp threads 102*a*, 102*b* within woven material 100. That is, corresponding warp threads 102*a*, 102*b* of woven material 100 may be positionally switched to form different or distinct decorative patterns 30 (see, FIG. 1) on top surface 118 and/or bottom surface 120 of woven material 100. As shown in FIG. 2B, warp threads 102*a*, 102*b* included in top portion of second group 112*a* of first layer ($L_1$) may be switched with corresponding warp threads 102*a*, 102*b* included in first portion of first group 110 of second layer ($L_2$). Additionally as shown in FIG. 2B, warp threads 102*a*, 102*b* included in bottom portion of second group 112*b* of fourth layer ($L_4$) may be switched with corresponding warp threads 102*a*, 102*b* included in second portion of first group 110 of third layer ($L_2$). The corresponding warp threads 102*a*, 102*b* of woven material 100 may be positionally switched using any suitable technique or process. In a non-limiting example where woven material 100 is formed using a dobby loom, the position of each of the warp threads 102*a*, 102*b* may be changed using the dobby loom while continuously coupling, weaving or interlacing weft thread 104 through the plurality of warp threads 102*a*, 102*b*.

Continuing the example above with respect to first column ($C_1$) in FIG. 2A, corresponding warp threads 102*a*, 102*b* included in first column ($C_1$) may be positionally switched in second length 34 to form decorative pattern 30, as shown in FIGS. 1 and 2B. More specifically, warp thread 102*a* of first layer ($L_1$) positioned in first column ($C_1$) may be positionally switched with corresponding warp thread 102*b* of second layer ($L_2$) positioned in first column ($C_1$). As shown in FIG. 2B, warp thread 102*b* may be positioned on top surface 118 and may be exposed to a user of wearable band 10, while warp thread 102*a* positioned within the inner portion may no longer be visible to a user. Additionally, warp thread 102*a* of fourth layer ($L_4$) positioned in first column ($C_1$) may be positionally switched with corresponding warp thread 102*b* of third layer ($L_3$) positioned in first column ($C_1$). That is, as shown in FIG. 2B, warp thread 102*b* may be positioned on bottom surface 120 and may be exposed to a user of wearable band 10, while warp thread 102*a* positioned within the inner portion may no longer be visible.

With comparison to FIG. 2A, all warp threads 102*a*, 102*b* may be positionally switched within woven material 100. More specifically, as shown in FIG. 2B, all warp threads 102*a*, 102*b* of top portion of second group 112*a* positioned within first layer ($L_1$) may be positionally switched with the respective corresponding warp threads 102*a*, 102*b* of the first portion of first group 110 positioned within second layer ($L_2$). Additionally, all warp threads 102*a*, 102*b* of bottom portion of second group 112*b* positioned within fourth layer ($L_4$) may be positionally switched with the respective corresponding warp threads 102*a*, 102*b* of the second portion of first group 110 positioned within third layer ($L_3$).

Although FIG. 2B shows all warp threads 102*a*, 102*b* being positionally switched within woven material 100, it is understood that only some of the warp threads 102*a*, 102*b* of woven material 100 may be positionally switched in forming wearable band 10. More specifically, the number and/or position of warp threads 102*a*, 102*b* positionally switched within woven material 100 may be dependent on at least one of: the decorative pattern 30 of woven material 100, the thread color(s) of first group 110 of warped threads 102*a*, 102*b*, the thread configuration of first group 110 of warped threads 102*a*, 102*b*, the thread color(s) of second group 112*a*, 112*b* of warped threads 102*a*, 102*b*, and the thread configuration of second group 112*a*, 112*b* of warped threads 102*a*, 102*b*.

Although discussed herein as being formed from the same material (e.g., polyamide material) throughout woven material 100, 600, it is understood that a plurality of materials may be used in forming woven material 100, 600. In a non-limiting example, warp threads 102*a*, 102*b* included in first layer ($L_1$) and second layer ($L_2$) may be formed from the treated or coated material, as discussed herein, to protect top surface 118 of woven material 100 from undesirable wear or stains. Additionally in the non-limiting example, warp threads 102*a*, 102*b* included in third layer ($L_3$) and fourth layer ($L_4$) forming bottom surface 120 may be formed from a softer, natural material such as cotton. The soft material (e.g., cotton) used to form third layer ($L_3$) and fourth layer ($L_4$), may feel more pleasant on a user's skin and/or provide a softer, bottom surface 120 of woven material 100 that may contact a user's skin wearing wearable band 10 (see, FIG. 1).

Figure 3:
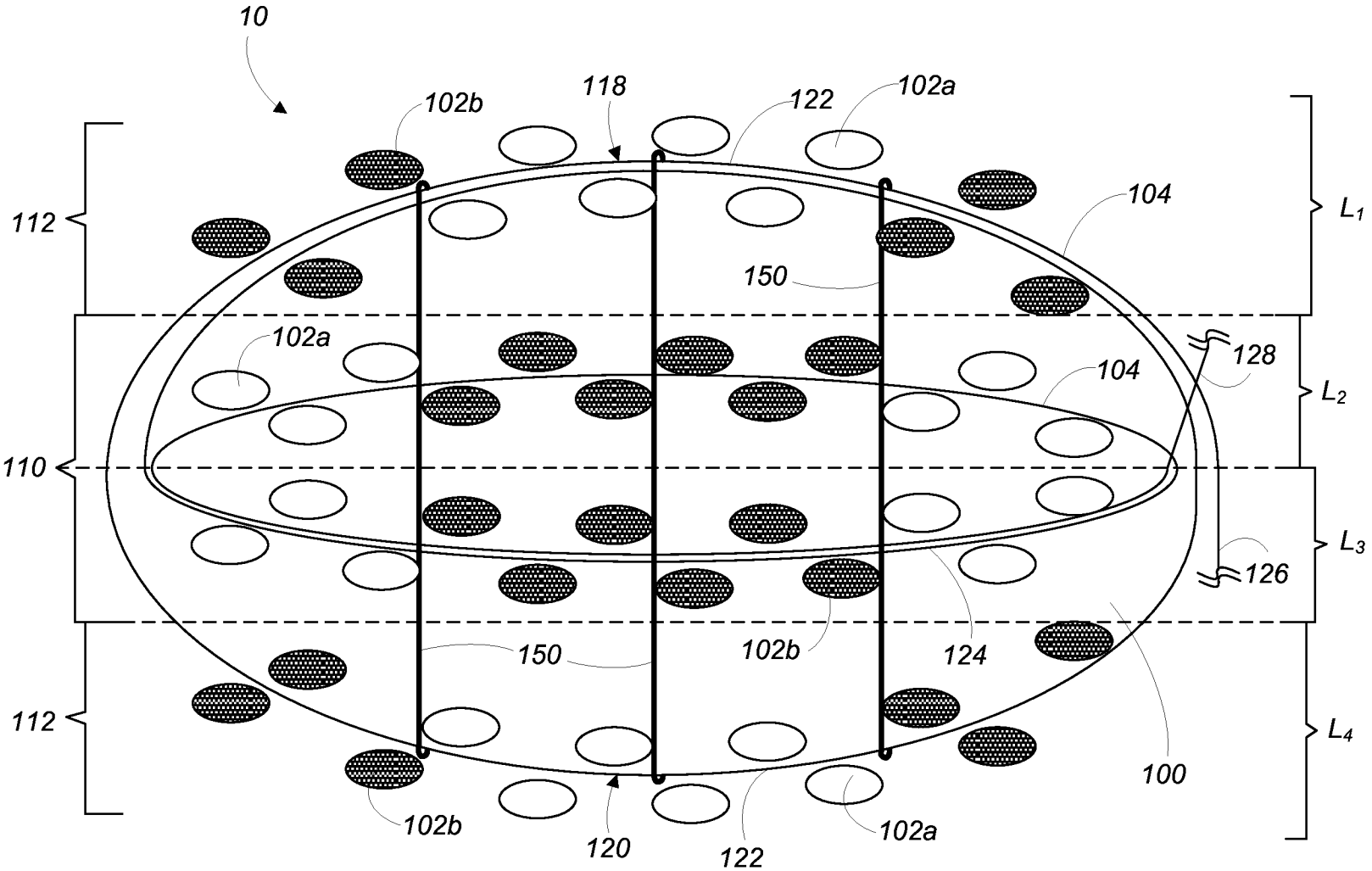
FIG. 3 shows a cross-section view of the wearable band of FIG. 1 taken along line 2B-2B, according to embodiments.

FIG. 3 also shows a cross-section view of the wearable band 10 of FIG. 1 taken along line 2B-2B. As shown in FIG. 3, woven material 100 forming wearable band 10 may include a plurality of connecting yarns 150 coupled to weft thread 104. More specifically, connecting yarns 150 of woven material 100 may include a plurality of connecting yarns 150 coupled to interior weft thread portion 124 of weft thread 104 and/or exterior weft thread portion 122 of weft thread 104. In a non-limiting example as shown in FIG. 3, connecting yarns 150 may be positioned completely through woven material 100, and more specifically, through the four layers ($L_{1-4}$) formed within woven material 100. That is, connecting yarns 150 may be coupled to exterior weft thread portion 122 included in top surface 118, and exterior weft thread portion 122 included in bottom surface 120 of woven material 100. Connecting yarns 150 of woven material 100 may aid in binding the various threads (e.g., warp threads, weft thread(s)) forming woven material 100, and/or may provide additional support for maintaining a uniform thickness throughout woven material 100.

Figure 4:
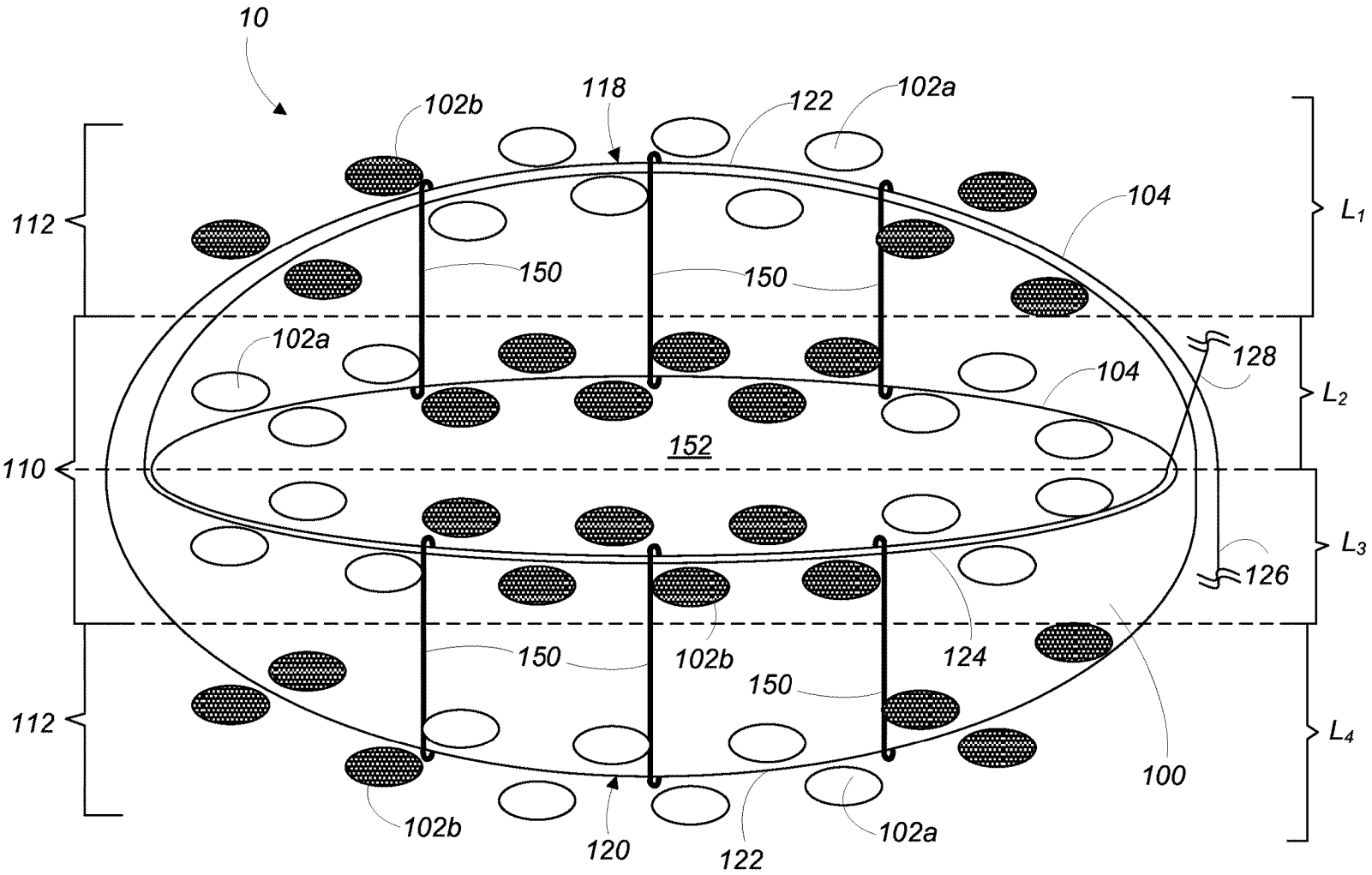
FIG. 4 shows a cross-section view of the wearable band of FIG. 1 taken along line 2B-2B, according to additional embodiments.

Connecting yarns 150 may not be positioned completely through woven material 100. That is, in an additional non-limiting embodiment shown in FIG. 4, connecting yarns 150 may only be positioned through portions of woven material 100. More specifically, a first collection of connecting yarns 150 may be coupled to exterior weft thread portion 122 included in top surface 118, and interior weft thread portion 124 coupled to first group 110 of warp threads 102*a*, 102*b* positioned adjacent top surface 118. That is, the first collection of connection yarns 150 may only be positioned within and/or may be substantially coupled first layer ($L_1$) and second layer ($L_2$) of woven material 100. Additionally, a second collection of connecting yarns 150 may be positioned opposite the first collection, and may be coupled to the exterior weft thread portion 122 included in bottom surface 120, and interior weft thread portion 124 coupled to first group 110 of warp threads 102*a*, 102*b* positioned adjacent bottom surface 120. As shown in FIG. 4, the second collection of connecting yarns 150 may only be positioned within and/or may be substantially coupled third layer ($L_3$) and fourth layer ($L_4$) of woven material 100. As a result of first collection and second collection of connecting yarns 150 being coupled to and/or substantially positioned within only a portion of woven material 100, an opening 152 may be formed within woven material 100 between top surface 118 and bottom surface 120. More specifically, opening 152 may be formed within woven material 100 as a result of coupling first layer ($L_1$) and second layer ($L_2$) using the first collection of connecting yarns 150, and coupling third layer ($L_3$) and fourth layer ($L_4$) using the second collection of connecting yarns 150. As shown in FIG. 4, opening 152 may be positioned between warp threads 102*a*, 102*b* included first group 110. Opening 152 may provide a space within woven material 100 that may be utilized to improve the functions and/or characteristics of woven material 100 forming wearable band 10. In a non-limiting example, opening 152 formed in woven material 100 may receive additional material (e.g., plastic strip) to provide additional structural support and/or stiffness to wearable band 10 formed from woven material 100.

Figure 5:
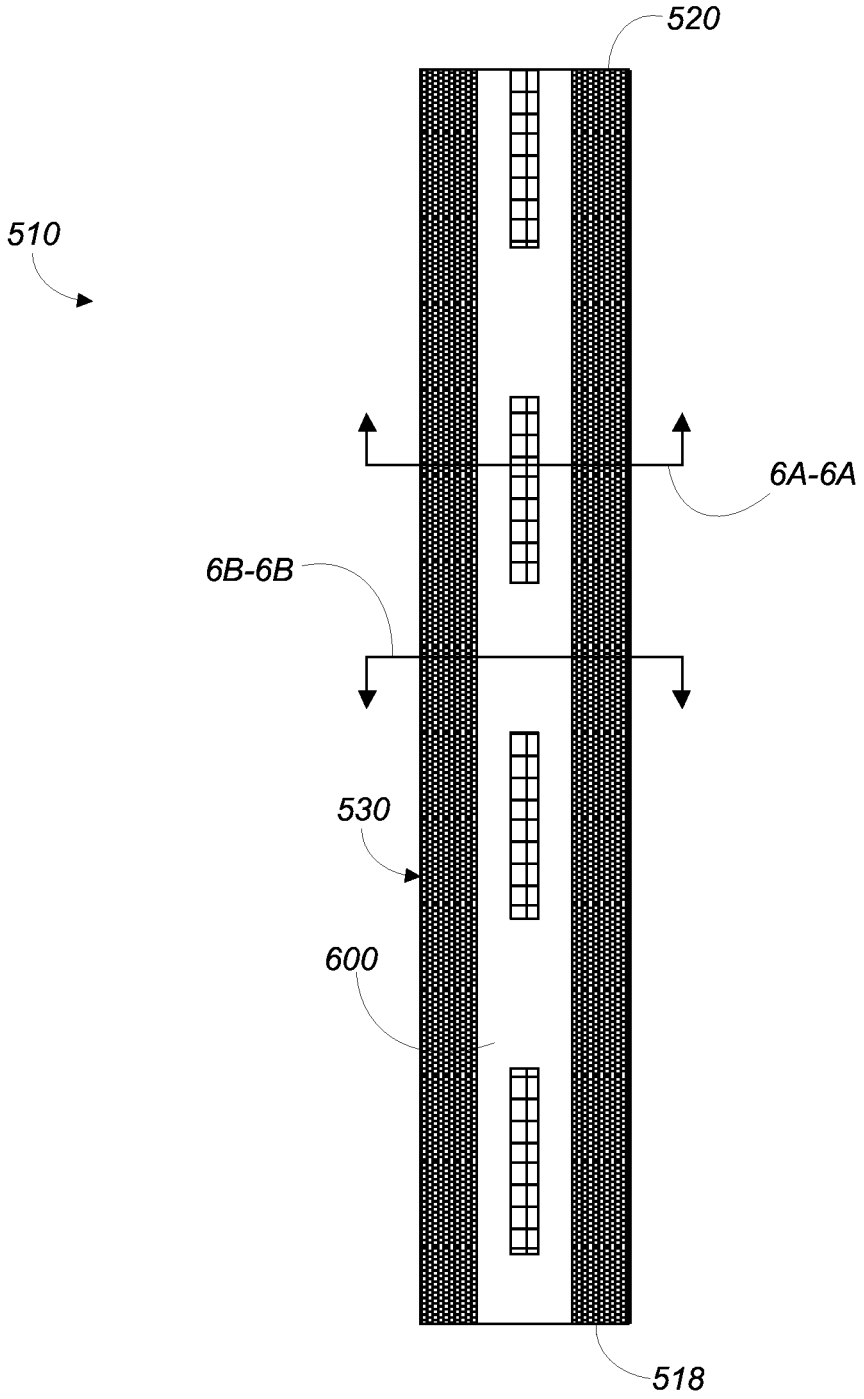
FIG. 5 shows an illustrative front view of a wearable band formed from a woven material, according to additional embodiments.

FIG. 5 shows an illustrative front view of a wearable band 510 including woven material 600, according to additional embodiments. As shown in FIG. 5, and discussed herein wearable band 510 formed from woven material 600 may include three distinct colors in decorative pattern 530. It is understood that similarly named components or similarly numbered components may function in a substantially similar fashion, may include similar materials and/or may include similar interactions with other components. Redundant explanation of these components has been omitted for clarity.

Coupling component 12 (see, FIG. 1) of wearable band 510 has been omitted from FIG. 3 for clarity. Although not shown, wearable band 510 may include any suitable coupling component 12 capable of coupling wearable band 510 to a user. In a non-limiting example, and as discussed herein with respect to FIG. 1, coupling component 12 of wearable band may include a plurality of holes and a buckle clasp formed at opposite ends 518, 520. In further not limiting examples (not shown), coupling component 12 may include any suitable coupling mechanisms or techniques for coupling wearable band 510 to a user including, but not limited to: magnetic clasps, snap-fits, buttons, hook-and-loop systems, ties, and ratchet systems.

Figure 6A:
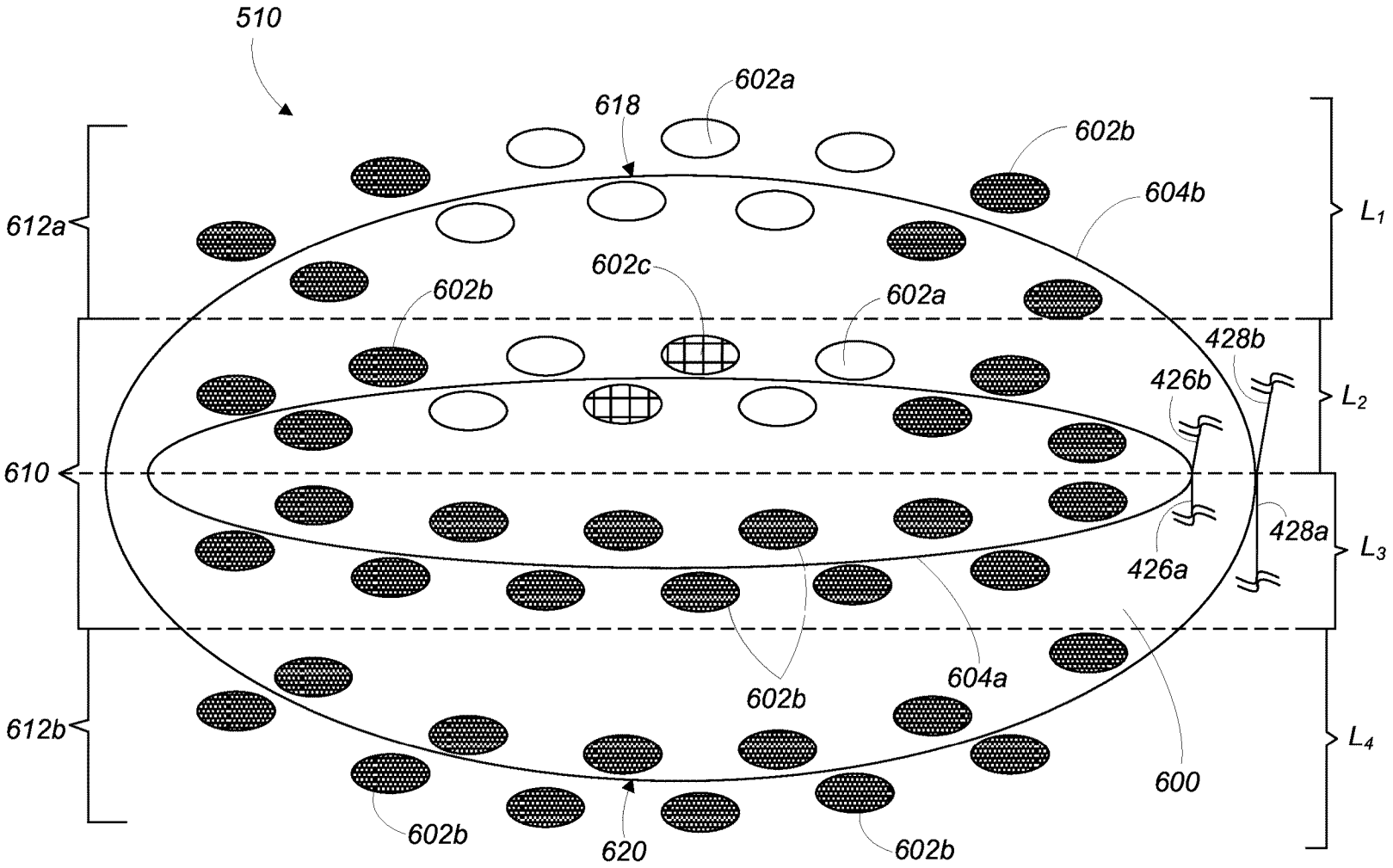
FIG. 6A shows a cross-section view of a first section of the wearable band of FIG. 5 taken along line 6A-6A, according to embodiments.

FIG. 6A shows a cross-section view of the wearable band 510 of FIG. 5 taken along line 6A-6A. Wearable band 510 may be formed from woven material 600. With comparison to FIG. 2A, woven material 600 forming wearable band 510, as shown in FIG. 6A, may be substantially similar to woven material 100 forming wearable band 10, and may include substantially similar components. However, distinct from woven material 100 of FIG. 2A, woven material 600 may include warp threads 602*a*, 602*b*, 602*c* including a plurality of colors. That is, woven material 600, as shown in FIG. 6A, may include warp threads 602*a* having a first color, warp threads 602*b* having a second color, and warp threads 602*c* having a third color, where the first color, the second color and the third color are all distinct from one another. Warp threads 602*c* having the third color may be formed in first group 610 of warp threads 602*a*, 602*b*, 602*c* in second layer ($L_2$) of woven material 100.

Additionally dissimilar to woven material 100 as shown in FIG. 2A, woven material 600 may include a distinct decorative pattern 530 on top surface 618 and bottom surface 620 of wearable band 510. That is, as shown in FIG. 6A, bottom surface 620 of woven material 600 may include only warp threads 602*b* having a second color in fourth layer ($L_4$). As such, bottom surface 620 may include a solid color (e.g., second color) and/or decorative pattern 530. To ensure bottom surface 620 of woven material 600 includes a solid color (e.g., second color) and/or decorative pattern 530, second portion of first group 610 in third layer ($L_3$) may also only include warp threads 602*b* having a second color.

Finally with comparison to woven material 100 shown in FIG. 2A, woven material 600 may include two distinct weft threads 606A, 606B. More specifically, as shown in FIG. 6A, woven material 600 forming wearable band 510 may include an interior weft thread 606A coupled to, woven or interlaced between first group 610 of warp threads 602*a*, 602*b*, 602*c*, and an exterior weft thread 606B substantially surrounding interior weft thread 606A and first group 610 of warp threads 602*a*, 602*b*, 602*c*. Exterior weft thread 606B may be coupled to, woven, or interlaced between second group 612*a*, 612*b* of warp threads 602*a*, 602*b*. Interior weft thread 606A and exterior weft thread 606B may function substantially similar to weft thread 104 (see, FIG. 2A) and may include substantially similar portions (e.g., prior layer portion 426*a*, 426*b*, subsequent layer portion 428*a*, 428*b*). As such, redundant explanation of these components has been omitted for clarity.

Figure 6B:
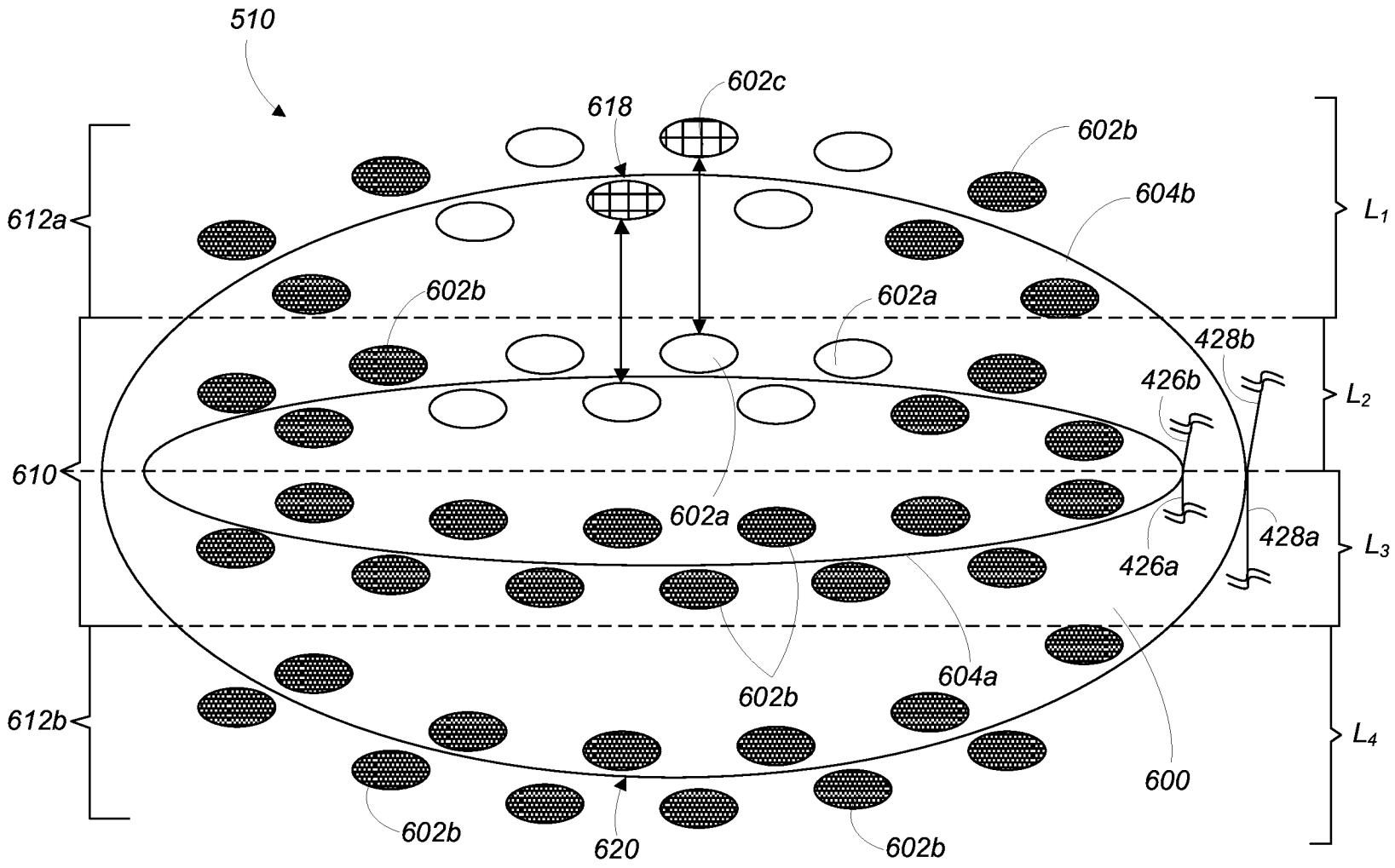
FIG. 6B shows a cross-section view of a second section of the wearable band of FIG. 5 taken along line 6B-6B, according to embodiments.

Turning to FIG. 6B, a cross-section view of a distinct portion of wearable band 510 of FIG. 5 taken along line 6B-6B is shown according to embodiments. As shown in FIG. 6B, top surface 618 of woven material 600 may include a distinct decorative pattern 530 for wearable band 510 along line 6B-6B when compared to the decorative pattern 530 for wearable band 510 along line 6A-6A (see, FIGS. 3 and 6A). As such, and as previously discussed herein with respect to FIGS. 2A and 2B, warp threads 602*a*, 602*b*, 602*c* may be positionally switched to form the distinct decorative pattern 530 formed in the portion of wearable band 510 depicted in FIG. 6B. However, distinct from woven material 100 as shown in FIG. 2B, woven material 600 forming wearable band 510 may not positionally switch all warp threads 602*a*, 602*b*, 602*c* to form decorative pattern 530. As shown in FIG. 6B, only a selection of warp threads 602*a*, 602*c* of woven material 600 may be positionally switched. More specifically, only two warp threads 602*a* of second group 612*a* positioned within first layer ($L_1$) may be positionally switched with two warp threads 602*c* of first group 610 positioned within second layer ($L_2$) to form the distinct decorative pattern 530 for wearable band 510 along line 6B-6B. Warp threads 602*c* of first group 610 may be switched with warp threads 602*a*, and may be positioned on top surface 618 to be viewed by a user of wearable band 510. As shown in FIGS. 6A and 6B, the remaining warp threads 602*a*, 602*b*, 602*c* of woven material 600 may not be positionally switched to maintain decorative pattern 530 of wearable band 510.

Although discussed herein as including symmetrical patterns (e.g., FIGS. 1-2B), or distinct patterns between the top surface and bottom surface (e.g., FIGS. 5-6B), it is understood that woven material 100, 600 may include any variation of color patterns or schemes. That is, in non-limiting examples, each of the four distinct layers ($L_{1-4}$) may include the same colors for the warp threads and/or weft threads, or may include all distinct colors for the warp threads and/or weft threads in the four distinct layers ($L_{1-4}$). Additionally, in an additional non-limiting example, each of the four distinct layers ($L_{1-4}$) can include warp threads having a plurality of distinct colors, such not only is the color between each layer of warp threads distinct, but within each layer they may be a plurality of distinctly colored warp threads.

Figure 7:
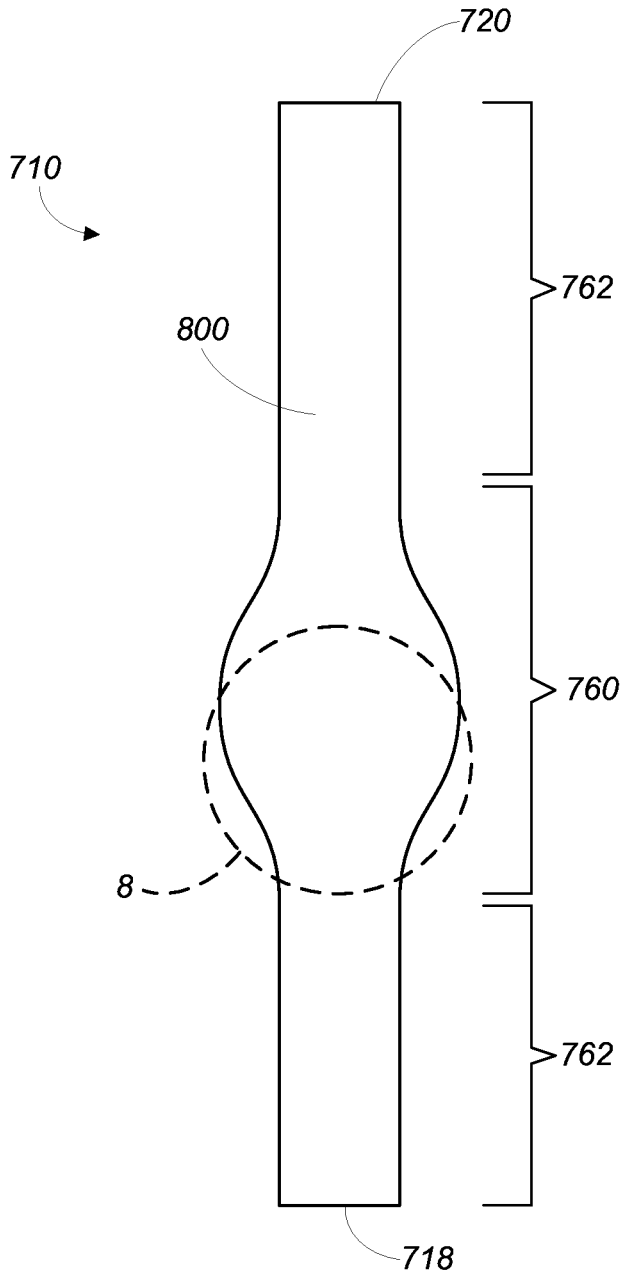
FIG. 7 shows an illustrative front view of a wearable band formed from a woven material, according to further embodiments.

FIG. 7 shows an illustrative front view of a wearable band 710 including woven material 800, according to additional embodiments. As shown in FIG. 7, and discussed herein, wearable band 710 formed from woven material 800 may include a single color in decorative pattern 730. As such, all warp threads 802 of woven material 800 may include the same colored thread. It is understood that similarly named components or similarly numbered components may function in a substantially similar fashion, may include similar materials and/or may include similar interactions with other components. Redundant explanation of these components has been omitted for clarity.

As shown in FIG. 7, and distinct from wearable band 10 (see, FIG. 1) and wearable band 510 (see, FIG. 5), wearable band 710 may include a tapered portion 760 positioned between end 718 and end 720. More specifically, tapered portion 760 may be positioned between uniform portions 762 of wearable band 710, where tapered portion 760 includes a varying width in wearable band 710, and uniform portions 762 include a uniform width in wearable band 710. As discussed herein, woven material 800 may form tapered portion 760 in wearable band 710. Tapered portion 760 may be included within wearable band 710 based on, at least in part, the function and/or intended use of wearable band 710. In a non-limiting example where wearable band 710 includes a watch band, tapered portion 760 may be included in wearable band 710 to position and/or secure a watching casing including a display (not shown) on wearable band 710. In an additional non-limiting example, where wearable band 710 includes a band for holding an electronic device, tapered portion 760 may provide additional surface area, and/or structural support for holding and/or coupling the electronic device to wearable band 710. In a further non-limiting example, where wearable band 710 includes a decorative band, tapered portion 760 may provide additional space to provide a visually appealing, decorative element, or item (e.g., logo, jewel, graphic, etc.).

When wearable band 710 is worn by a user, uniform portions 762 may be positioned adjacent to, substantially around and/or contact a user's wrist to coupled wearable band 710 to a user. In order to prevent and/or minimize interference with a user's wrist movement while wearing wearable band 710, uniform portions 762 of wearable band 710 may include a width smaller than tapered portion 760, as shown in FIG. 7.

Figure 8:
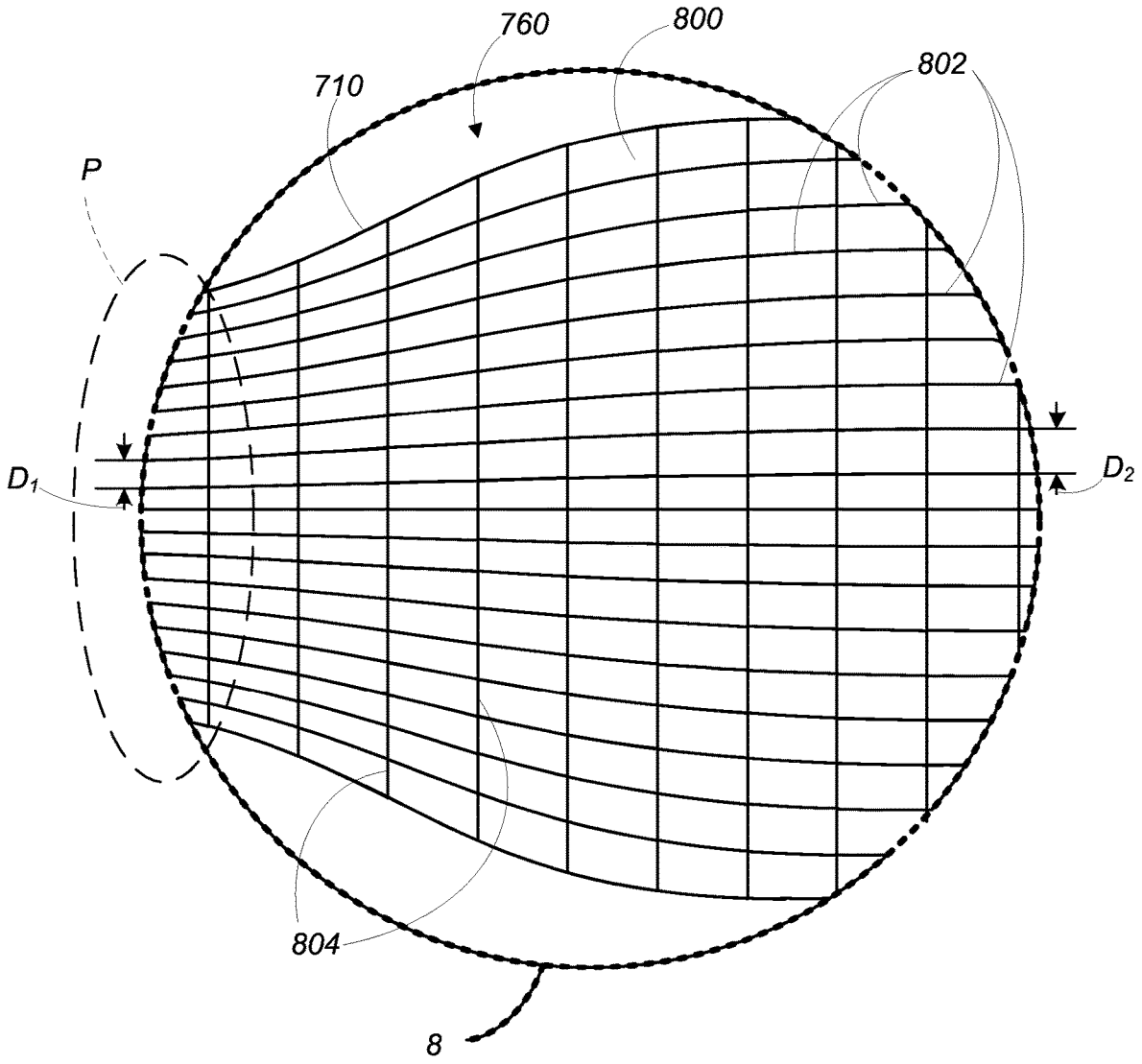
FIG. 8 shows an enlarged tapered portion of the wearable band including woven material as depicted in FIG. 7, according to embodiments.

FIG. 8 shows an enlarged portion 8 of wearable band 710 formed from woven material 800, as depicted in FIG. 7. More specifically, FIG. 8 shows an enlarged view of a portion of tapered portion 760 of wearable band 710 formed from woven material 800. Woven material 800 of wearable band 710 may include warp threads 802 and weft thread(s) 804 coupled to warp threads 802, as discussed herein. Similar to FIG. 2A, it is understood that the number of threads shown in FIG. 8 to form woven material 800 may be merely exemplary. That is, the number of warp threads 802 and weft threads 804 shown in FIG. 8 may be merely exemplary for clearly and completely describing the disclosure, and may not represent the actual number of warp threads 802 and/or weft threads 804 used to form woven material 800.

As shown in FIG. 8, tapered portion 760 of woven material 800 forming wearable band 710 may be formed as a result of increasing the distance (D) between the warp threads 802 of woven material 800. That is, in order to form tapered portion 760 of wearable band 710, the overall width of woven material 800 is increased by increasing the distance (D) between each of the plurality of warp threads 802. As shown in FIG. 8, the portion (P) of woven material 800 not included in tapered portion 760 may include a first distance ($D_1$) between each warp thread 802. In comparison, warp threads 802 included within tapered portion 760 of woven material 800 may include a second distance ($D_2$) between each warp thread 802, where the second distance (D2) is greater than the first distance ($D_1$).

By increasing the distance (D) between each of the plurality of warp threads 802 to form tapered portion 760, the fiber density (e.g., warp thread density, weft thread density) of woven material 800 may be decreased in tapered portion 760, which may ultimately result in inconsistent thickness in wearable band 710 at tapered portion 760. However, a uniform thickness may be substantially provided within wearable band 710 formed from woven material 800 as a result of increasing weft thread 804 length in tapered portion 760. As shown in FIG. 8, the length of weft thread 804 may substantially increase as the width of woven material 800 increases in tapered portion 760. The increase in the length of the weft thread 804 as the width of woven material 800 increases may increase the fiber density of the weft threads 804, and may substantially offset the decreasing density of warp threads 802 in tapered portion 760. That is, as the density of warp threads 802 decreases in tapered portion 760 as a result of the distance (D) between warp threads 802 increasing, the length of the weft threads 804 in tapered portion 760 may increase which may result in an increase in the density of the weft threads. As such, the increase in density of the weft threads 804 in tapered portion 760 may offset the decrease in density of the warp threads 802, which may result in the fiber density of woven material 800 remaining substantially consistent throughout wearable band 710. More specifically, fiber density may remain substantially consistent and/or equal in tapered portion 760 and uniform portions 762 of wearable band 710. Furthermore, as a result of fiber density remaining substantially consistent, regardless of the width of woven material 800 and/or wearable band 710, the thickness of woven material 800 forming wearable band 710 may also remain substantially consistent and/or uniform.

Additionally, the thickness of wearable band 710 at tapered portion 760 may also be increased as a result of woven material 700 being formed from four distinct layers ($L_{1-4}$). That is, and as discussed herein, when forming tapered portion 760, the distance (D) between each of the plurality of warp threads 802 to form tapered portion 760 is increased, resulting in the fiber density (e.g., warp thread density, weft thread density) of woven material 800 to decreased in tapered portion 760. This may ultimately result in inconsistent thickness in wearable band 710 at tapered portion 760. However, the thickness of woven material 800 forming wearable band 710 may be substantially increased by increasing weft thread 804 length, and/or weft thread 804 weaving pattern in tapered portion 760. That is, the length of weft thread 804 may be increased to provide more weft thread 804 woven through the warp threads 802 forming woven material 800 to increase thickness. In addition, the weave pattern of weft thread 804 may be modified to provide more wraps of weft thread 804 within tapered portion 760 to increase the thickness of woven material 800 at tapered portion 760 as well.

Figure 9:
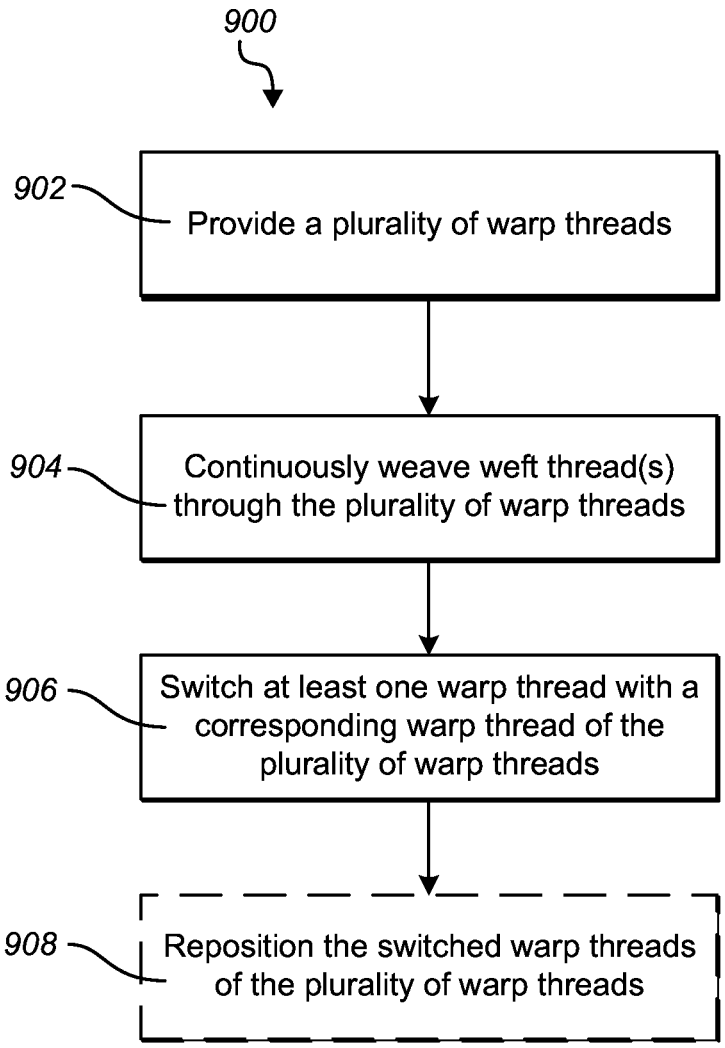
FIG. 9 shows a flow chart illustrating a method of forming a woven material. This method may be performed to form the woven material as shown in FIGS. 1-8.

Turning to FIG. 9, a method of forming a woven material 100, 600, 800 (FIGS. 1-8) is now discussed. Specifically, FIG. 9 is a flowchart depicting one sample method 900 for forming a woven material, as discussed herein with respect to FIGS. 1-8.

In operation 902, a plurality of warp threads are provided. The plurality of warp threads may include four distinct layers of warp threads. More specifically, plurality of warp threads may include a first layer of warp threads forming a top surface of the woven material, and a second layer of warp threads positioned adjacent the first layer of warp threads. The second layer of warp threads may be positioned in an inner portion of the woven material. The plurality of warp threads may also include a third layer positioned adjacent the second layer of warp threads. Similar to the second layer of warp threads, the third layer of warp threads may be positioned in the inner portion of the woven material, and may not been seen by a user. Finally, the plurality of warp threads may include a fourth layer of warp threads positioned adjacent the third layer of warp threads, and opposite the first layer of warp threads. The fourth layer of warp threads may form a bottom surface of the woven material. The plurality of warp threads may be substantially similar to the warp threads discussed herein with respect to FIGS. 1-8.

In operation 904, at least one weft thread may be continuously woven through the plurality of warp threads over a predetermined length of the warp threads. More specifically, the weft thread may be coupled to, woven or interlaced with the warp threads included in all four of the distinct layers of the provided warp threads. The weft thread may include a single thread woven through the warp threads, as similarly discussed herein with respect to FIGS. 1-4. In a further example embodiment, the weft thread may include a plurality of weft threads woven through the warp threads, as similarly discussed herein with respect to FIGS. 5-6B.

In operation 906, at least one warp thread of one of the four layers may be switched with a corresponding warp thread in an adjacent, distinct layer. More specifically, in a first length of the plurality of warp threads forming the woven material, at least one warp thread in the first layer may be positionally switched or swapped with a corresponding warp thread in the second layer. The switching of the warp threads may include positioning at least one warp thread of the first layer within the inner portion of the woven material. Additionally, the switching of the warp threads may include positioning the at least one corresponding warp thread of the second layer on the top surface of the woven material. The switching may also include switching at least one warp thread in the fourth layer of warp threads with a corresponding warp thread in the third layer. More specifically, at the first length of the plurality of warp threads forming the woven material, at least one warp thread of the fourth layer may be positioned within the inner portion. In addition, at least one corresponding warp thread of the third layer may be positioned on the bottom surface of the woven material. As discussed herein, all of the plurality of warp threads included in the four layers may be switched (see, FIG. 2B) or, only a portion of the warp threads included in the four layers may be switch (see, FIG. 6B).

In optional operation 908, at least a portion of the switched warp threads may be repositioned in a second length of the plurality of warp threads. More specifically, at least a portion of the positionally switched warp threads in the first length of the warp threads, may be repositioned or switched back in a second length of the plurality of warp threads. In the second length of the plurality of warp threads, the at least one positionally switched warp thread in the second layer may be repositioned back to the top surface and/or the first layer. Additionally in the second length of the plurality of warp threads, the at least one corresponding, positionally switched warp thread in the first layer may be repositioned back to the second layer. Furthermore, the positionally switched warp thread(s) and corresponding warp thread(s) in the third layer and fourth layer may be repositioned to their respective layer. As discussed herein, the switching and/or repositioning of the warp threads may form a decorative pattern within the woven material, and the exact warp thread(s) switched and/or repositioned may be dependent on the pattern formed in the woven material.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

We claim:

1. A woven material comprising:

a continuous weft thread comprising an interior weft thread portion and an exterior weft thread portion;

a first group of warp threads, the interior weft thread portion interwoven with and directly contacting each of the first group of warp threads in a first length of the woven material;

a second group of warp threads substantially surrounding the first group of warp threads and the interior weft thread portion in the first length of the woven material, the exterior weft thread portion interwoven with and directly contacting each of the second group of warp threads in the first length of the woven material;

wherein, between the first length of the woven material and a second length of the woven material, the first group of warp threads and the second group of warp threads switch positions such that, in the second length of the woven material, the first group of warp threads is substantially surrounding the second group of warp threads.

2. The woven material of claim 1, wherein the first group of warp threads include at least one color thread.

3. The woven material of claim 2, wherein the second group of warp threads include at least one color thread, wherein the at least one color thread of the second group of the warp threads is distinct from the at least one color thread of the first group of the warp threads.

4. The woven material of claim 1, further comprising:

a top surface including a top portion of the second group of warp threads and the exterior weft thread portion; and a bottom surface positioned opposite the top surface, the bottom surface including a bottom portion of the second group of warp threads and the exterior weft thread portions.

5. The woven material of claim 4, further comprising connecting yarns coupled to at least one of the interior weft thread portion and the exterior weft thread portion.

6. The woven material of claim 5, wherein the connecting yarns are coupled to:

the exterior weft thread portion included within the top surface; and the exterior weft thread portion included within the bottom surface.

7. The woven material of claim 5, wherein the connecting yarns include:

a first collection of connecting yarns coupled to:

the exterior weft thread portion included within the top surface; and the interior weft thread portion; and a second collection of connecting yarns positioned opposite the first collection of connecting yarns, the second collection of connecting yarns coupled to:

the exterior weft thread portion included within the bottom surface; and the interior weft thread portion.

8. The woven material of claim 7, further comprising an opening positioned between the top surface and the bottom surface.

9. The woven material of claim 4, further comprising:

a first layer including the top portion of the second group of warp threads and the exterior weft thread portion forming the top surface;

a second layer positioned directly adjacent the first layer, the second layer including a first portion of the first group of warp threads and the interior weft thread portion;

a third layer positioned directly adjacent the second layer, the third layer including a second portion of the first group of warp threads and the interior weft thread portion; and a fourth layer positioned directly adjacent the third layer and opposite the first layer, the fourth layer including the bottom portion of the second group of warp threads and the exterior weft thread portions forming the bottom surface.

10. The woven material of claim 9, wherein each of the warp threads in the top portion of the second group of warp threads included in the first layer are substantially aligned with a corresponding warp thread in:

the first portion of the first group of warp threads included in the second layer;

the second portion of the first group of warp threads included in the third layer; and the bottom portion of the second group of warp threads included in the fourth layer.

11. The woven material of claim 10, wherein, between a first section of the woven material and a second section of the woven material, a warp thread included in the top portion of the second group of warp threads included in the first layer switches positions with a warp thread included in the first portion of the first group of warp threads included in the second layer.

12. The woven material of claim 10, wherein, between a first section of the woven material and a second section of the woven material, a warp thread included in the bottom portion of the second group of warp threads included in the fourth layer switches positions with a warp thread included in the second portion of the first group of warp threads included in the third layer.

13. A wearable band comprising:

a woven material including, in a first length of the woven material:

a first warp thread positioned within a first layer of the woven material;

a second warp thread positioned within a second layer of the woven material;

a third warp thread positioned within a third layer of the woven material; and a fourth warp thread positioned within a fourth layer of the woven material; and a weft thread coupled to and in direct contact with the first, second, third, and fourth warp threads, wherein the weft thread extends through each of the first, second, third, and fourth layers of the woven material;

wherein the second layer is between the first and third layers, and the third layer is between the second and fourth layers;

wherein, between the first length of the woven material and a second length of the woven material, the first warp thread and the second warp thread switch positions, such that, in the second length of the woven material:

the first warp thread is positioned within the second layer of the woven material;

the second warp thread is positioned within the first layer of the woven material;

the third warp thread is positioned within the fourth layer of the woven material; and the fourth warp thread is positioned within the third layer of the woven material.

14. The wearable band of claim 13, wherein the first warp thread is positioned on one of the top surface or the bottom surface of the woven material in a second section of the length of the woven material.

15. The wearable band of claim 14, wherein the second warp thread is positioned within the inner portion of the woven material in the second section of the length of the woven material.

16. The wearable band of claim 13, wherein:

in the first section, the first warp thread is in a first position within the inner portion of the woven material and the second warp thread is in a second position on the top surface and the bottom surface of the woven material; and in the second section, the first warp thread is in the second position and the first warp thread is in the first position.

17. A woven material comprising:

first warp threads;

second warp threads;

third warp threads;

fourth wrap threads; and a continuous weft thread coupled to and in direct contact with each of the first warp threads, the second warp threads, the third warp threads, and the fourth warp threads;

wherein:

in a first length of the woven material, the second warp threads define a first exterior surface of the woven material, the third warp threads define a second exterior surface of the woven material, and the second and third warp threads substantially surround the first and fourth warp threads; and in a second length of the woven material, the first warp threads define a second exterior surface of the woven material, the fourth warp thread define a second exterior surface of the woven material, and the first and fourth warp threads substantially surround the second and third warp threads.

18. The woven material of claim 17, wherein the weft thread comprises:

a first interior weft thread portion in the first length of the woven material and coupled to the first warp threads;

a first exterior weft thread portion in the first length of the woven material and coupled to the second warp threads;

a second interior weft thread portion in the second length of the woven material and coupled to the second warp threads; and a second exterior weft thread portion in the second length of the woven material and coupled to the first warp threads.

19. The woven material of claim 18, wherein:

in the first length of the woven material, the second warp threads substantially surround the first interior weft thread portion; and in the second length of the woven material, the first warp threads substantially surround the second interior weft thread portion.

* * * * *